US011904229B2

(12) United States Patent
Noccioli et al.

(10) Patent No.: US 11,904,229 B2
(45) Date of Patent: Feb. 20, 2024

(54) SKATEBOARD SUSPENSION

(71) Applicant: Bajaboard International Pty Ltd, Victoria (AU)

(72) Inventors: Alessandro Noccioli, Victoria (AU); Zi Ping Li, Victoria (AU)

(73) Assignee: Bajaboard International Pty Ltd, Templestowe Lower (AU)

( * ) Notice: Subject to any disclaimer, the term of this patent is extended or adjusted under 35 U.S.C. 154(b) by 220 days.

(21) Appl. No.: 17/626,660

(22) PCT Filed: Jul. 8, 2020

(86) PCT No.: PCT/IB2020/056399
§ 371 (c)(1),
(2) Date: Jan. 12, 2022

(87) PCT Pub. No.: WO2021/005516
PCT Pub. Date: Jan. 14, 2021

(65) Prior Publication Data

US 2022/0331686 A1 Oct. 20, 2022

(30) Foreign Application Priority Data

Jul. 9, 2019 (AU) ..... 2019902430

(51) Int. Cl.
*A63C 17/00* (2006.01)
*A63C 17/01* (2006.01)

(52) U.S. Cl.
CPC ..... *A63C 17/0046* (2013.01); *A63C 17/012* (2013.01); *A63C 17/015* (2013.01); *A63C 2203/42* (2013.01)

(58) Field of Classification Search
CPC . A63C 17/0046; A63C 17/012; A63C 17/015; A63C 2203/42
See application file for complete search history.

(56) References Cited

U.S. PATENT DOCUMENTS

| | | | | |
|---|---|---|---|---|
| 5,330,214 | A * | 7/1994 | Brooks | A63C 17/01 280/11.27 |
| 5,950,754 | A * | 9/1999 | Ondrish, Jr. | A63C 17/01 180/181 |
| 2006/0244230 | A1* | 11/2006 | Glowner | A63C 17/015 280/87.042 |
| 2011/0215544 | A1 | 9/2011 | Rhodig | |
| 2016/0206949 | A1* | 7/2016 | Murphy | A63C 17/015 |
| 2016/0272264 | A1 | 9/2016 | Mogensen et al. | |
| 2016/0318562 | A1* | 11/2016 | Mainville | A63C 17/0046 |
| 2017/0210433 | A1 | 7/2017 | Radenbaugh et al. | |
| 2020/0078661 | A1* | 3/2020 | Saez | A63C 17/0046 |
| 2021/0171132 | A1* | 6/2021 | Underwood | B62D 21/04 |

FOREIGN PATENT DOCUMENTS

| | | |
|---|---|---|
| WO | 2015027272 | 3/2015 |
| WO | 2018170528 | 9/2018 |

* cited by examiner

*Primary Examiner* — Brian L Swenson
(74) *Attorney, Agent, or Firm* — Ruggiero McAllister & McMahon LLC

(57) ABSTRACT

A suspension for a skateboard, comprising a pair of steering knuckles on opposite sides of a chassis frame of the skateboard, a pair of upper control arms connected between the pair of steering knuckles and the chassis frame, a pair of lower control arms connected between the pair of steering knuckles and the chassis frame, and a first spring damper connected between the pair of upper control arms.

13 Claims, 6 Drawing Sheets

SKATEBOARD SUSPENSION

This application is the National Stage filing under 35 U.S.C. 371 of International Application No. PCT/IB2020/056399, filed Jul. 8, 2020, claims the benefit of Australian Application No. 2019902430, filed Jul. 9, 2019, the contents of which are all hereby incorporated by reference herein in their entirety.

FIELD

The present invention relates to suspensions for skateboards, such as motorised all-terrain skateboards.

BACKGROUND

Suspension systems have been proposed for all-terrain (or off-road) motorised skateboards to provide riders with predictable and stable handling and steering in all kinds of terrains. Such suspension systems typically add weight, cost and complexity to skateboards.

A need therefore exists for simple and lightweight suspensions for all-terrain skateboards.

SUMMARY

According to the present invention, there is provided a suspension for a skateboard, comprising:

- a pair of steering knuckles on opposite sides of a chassis frame of the skateboard;
- a pair of upper control arms connected between the pair of steering knuckles and the chassis frame;
- a pair of lower control arms connected between the pair of steering knuckles and the chassis frame; and
- a first spring damper connected between the pair of upper control arms.

The suspension may further comprise an anti-roll system connected between the pair of upper control arms and the chassis frame.

The anti-roll system may comprise a pair of second spring dampers connected between the pair of upper control arms and the chassis frame.

The suspension may enable the chassis frame to tilt laterally about a longitudinal axis of the chassis frame without changing ride height.

The anti-roll system may bias the chassis frame to return to a neutral position after lateral tilting of the chassis about the longitudinal axis.

Each upper control arm may comprise a generally pyramidal frame having an upper, inner vertex.

The first spring damper may be connected between the upper, inner vertices of pyramidal frames of the pair of upper control arms.

The pair of second spring dampers may be packaged inside the pyramidal frames of the pair of upper control arms.

Each lower control arm may comprise an A-arm or a wishbone.

Each spring damper may comprise a coil-over shock absorber.

The present invention also provides a skateboard comprising at least one suspension described above.

The skateboard may comprise a pair of front wheels and a pair of rear wheels, and wherein the suspension described above is provided between each of the pairs of front and rear wheels.

The skateboard may comprise a motorised all-terrain skateboard, or a non-motorised all-terrain skateboard.

BRIEF DESCRIPTION OF DRAWINGS

Embodiments of the invention will now be described by way of example only with reference to the accompanying drawings, in which.

DESCRIPTION OF EMBODIMENTS

Figure 1:
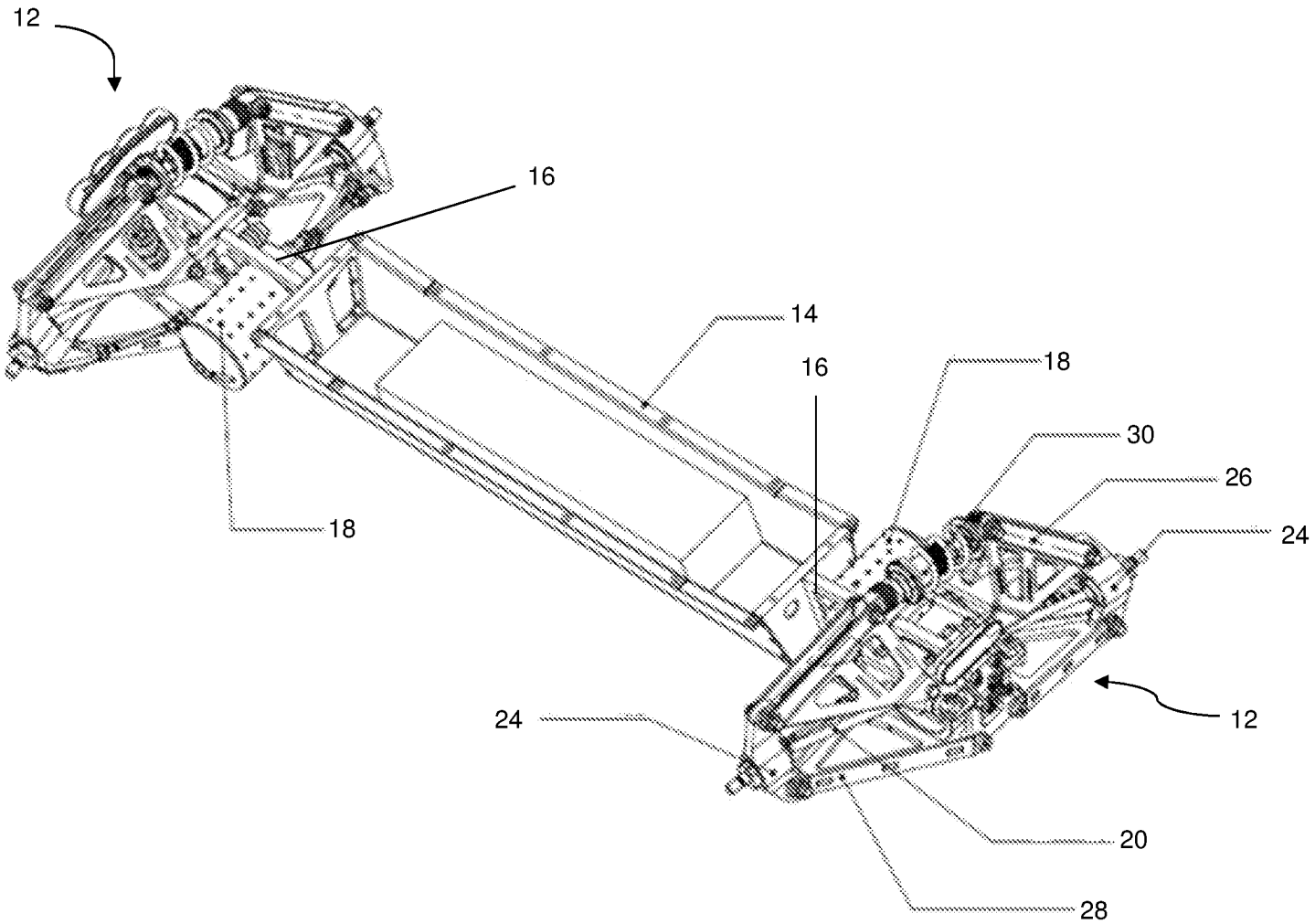
FIG. 1 is a perspective, partially assembled view of an electric all-terrain skateboard comprising front and rear suspensions according to an embodiment of the present invention.
Figure 2:
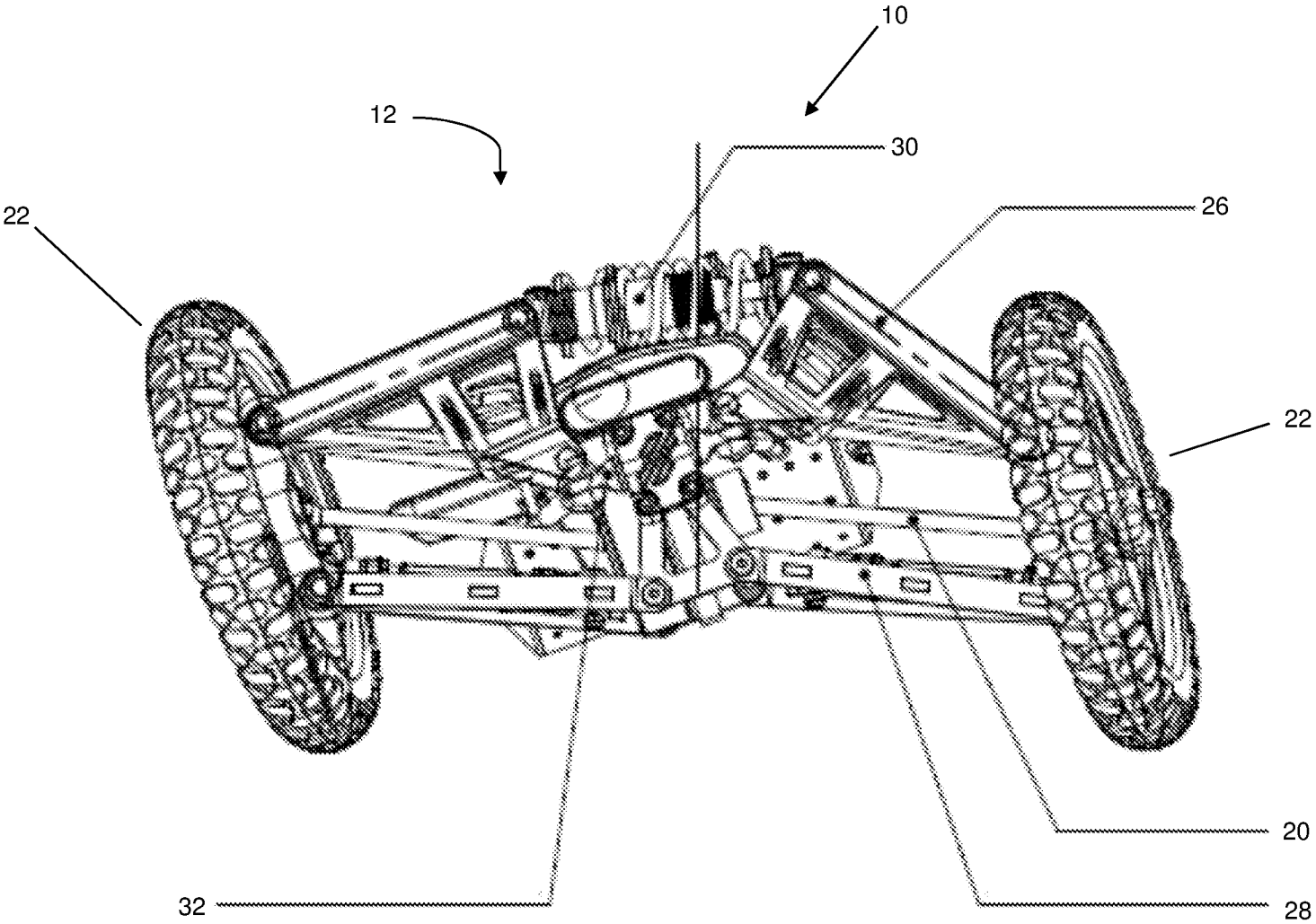
FIG. 2 is a front view of the suspension.
Figure 4:
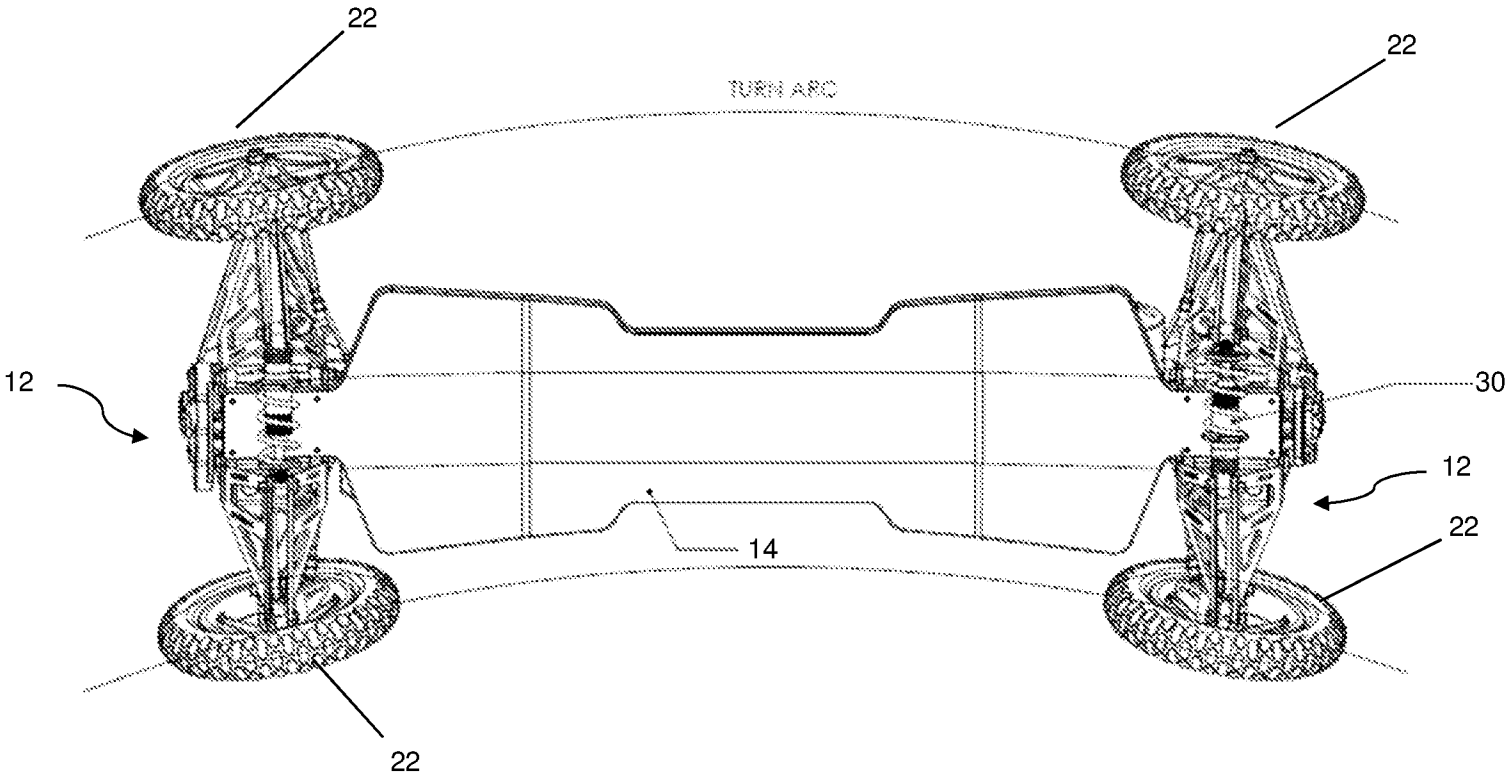
FIG. 4 is a top perspective view of the skateboard showing the suspension during turning.

FIGS. 1 to 2 and 4 illustrate a skateboard 10 comprising front and rear suspensions 12 according to an embodiment of the present invention. The skateboard 10 may, for example, comprise a motorised all-terrain skateboard 10, such as an electric all-terrain skateboard 10. The all-terrain skateboard 10 may generally comprise the skateboard, with the exception of the suspension, described in the present applicant's WO 2015027272, which is hereby incorporated in its entirety. The skateboard 10 may comprise an elongate chassis box 14 having front and rear chassis frames 16. A deck (not shown in FIG. 1) may be mounted to the chassis box 14. Electric motors 18 may be mounted to each of the front and rear chassis frames 16. A pair of axles 20 may be connected between each of the electric motors 18 and pairs of front and rear wheels 22 (not shown in FIG. 1).

Each suspension 12 may comprise a pair of steering knuckles 24 on opposite sides of the chassis frame 16. A pair of wheels 22 may be mounted to the pair of steering knuckles 24. A pair of upper control arms 26 may be pivotally connected between the pair of steering knuckles 24 and the chassis frame 16. A pair of lower control arms 28 may be pivotally connected between the pair of steering knuckles 24 and the chassis frame 16. A first spring damper (or "mono-shock") 30 may be pivotally connected between the pair of upper control arms 26. The first spring damper 30 may be generally horizontally arranged between the pair of upper control arms 26.

Figure 3:
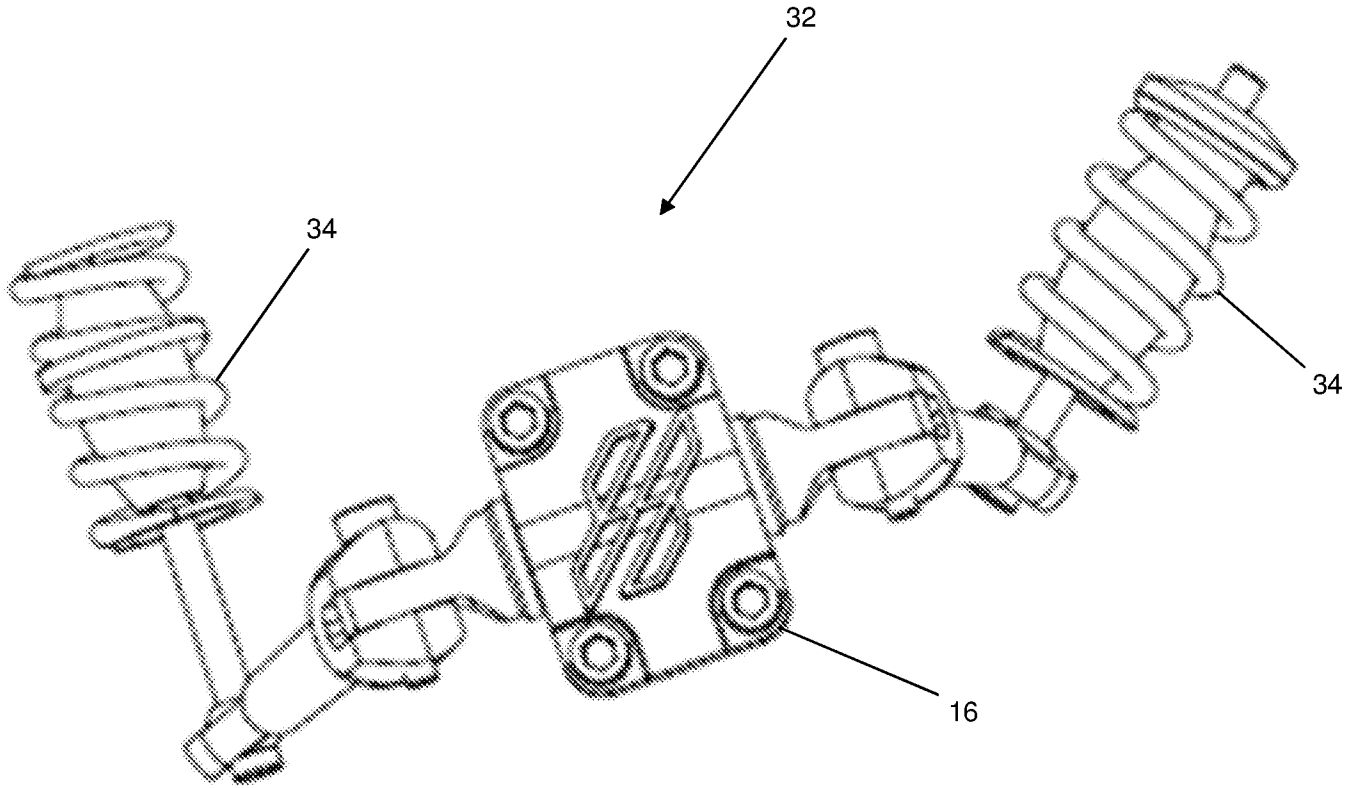
FIG. 3 is a front view of an anti-roll system of the suspension.

Referring to FIG. 3, each suspension 12 may further comprise an anti-roll system 32 pivotally connected between the pair of upper control arms 26 and the chassis frame 16. The anti-roll system 32 may comprise a pair of second spring dampers 34 pivotally connected between the pair of upper control arms 26 and the chassis frame 16. Each second spring damper 34 may be generally horizontally arranged between the pair of upper control arms 26 and the chassis frame 16.

Figure 5:
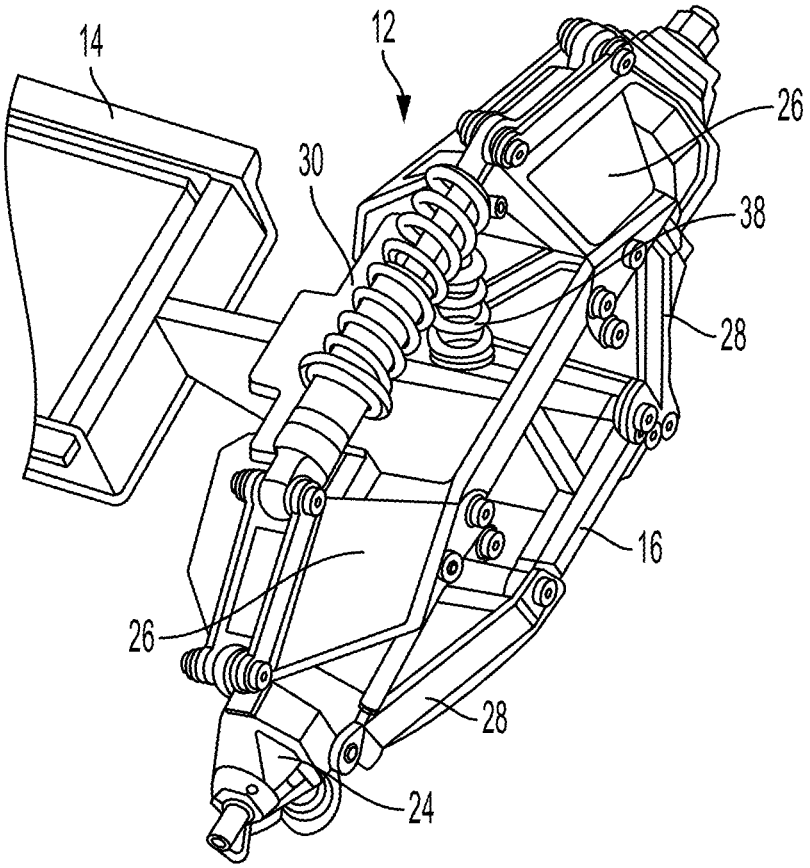
FIG. 5 is a top perspective view of an alternative embodiment of the suspension.
Figure 6:
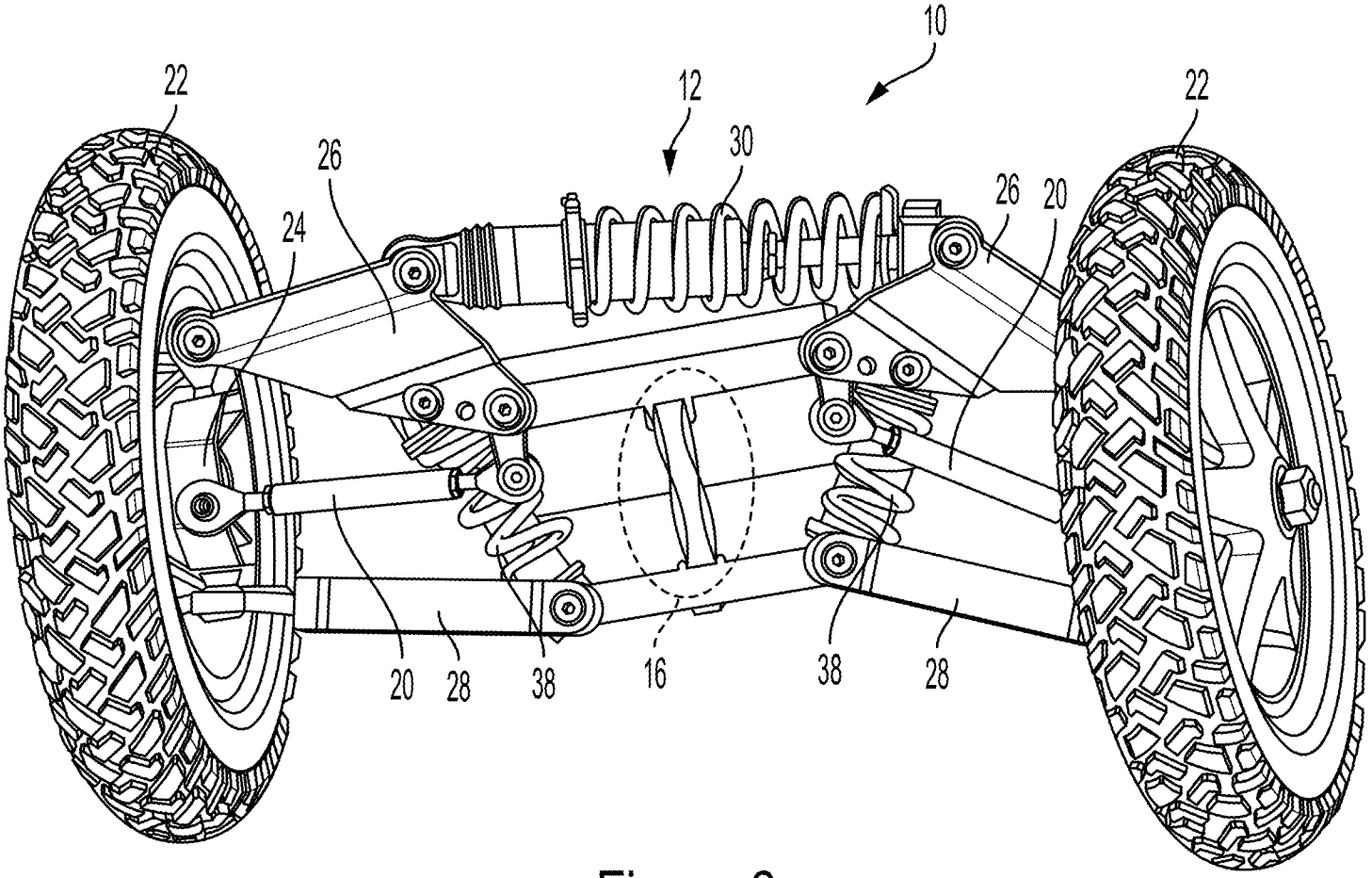
FIG. 6 is a front perspective view of the alternative embodiment of the suspension.

An alternative embodiment of the suspension 12 is illustrated in FIGS. 5 and 6. In this embodiment, the anti-roll system 32 may be replaced by a pair of turn spring dampers 38 connected between the pair of upper control arms 26 and the chassis frame 16 (or bulkhead). The top of each turn spring 38 may be pivotally connected to the upper control arm 26, while the bottom of each turn spring 38 may be non-pivotally connected to an extension of the chassis frame 16.

For example, the top of the turn spring 38 may be held by an upper spring holder linkage that is held at opposite ends by the upper control arm 26. The upper spring holder linkage may be free to rotate so that the top of the turn spring 38 may pivot. In contrast, the bottom of the turn spring 38 may be held by a lower spring holder linkage that is fixed or locked in place so that it cannot pivot. As a result, as the skateboard 10 turns, the top of the turn spring 38 may pivot to match the angle of the bottom of the turn spring 38. Each turn spring 38 may, for example, comprise a coil-over shock absorber, or a damper inside a spring. It will be appreciated that the upper spring holder may alternatively be non-pivotally connected so that the turn spring 38 may bow as it compresses. In addition, it will be appreciated that the turn spring 38 does not necessarily have to be a coil spring as illustrated, but may alternatively comprise any elastic material or mechanism.

Each upper control arm 26 may comprise a generally pyramidal (ie, in the shape of a tetrahedral pyramid) frame having an upper, inner vertex. The first spring damper 30 may be generally horizontally connected between the upper, inner vertices of pyramidal frames of the pair of upper control arms 26. The pair of second spring dampers 34 may be generally diagonally packaged inside the pyramidal frames of the pair of upper control arms 26. Each lower control arm 28 may comprise an A-arm or a wishbone.

The first spring damper 30 and the pair of second spring dampers 34 may each comprise, for example, a coil-over or air shock absorber.

Referring to FIG. 4, in use, the suspension 12 may enable the chassis frame 16 to tilt laterally about a longitudinal axis of the chassis frame 16 without changing ride height. Furthermore, the anti-roll system 32, or the turn spring dampers 38 in the alternative embodiment, may bias the chassis frame 16 to return to a neutral (ie, a balanced, untilted) position after lateral tilting of the chassis frame 16 about the longitudinal axis.

The skateboard 10 may be implemented as a one-, two-, three-, or four-wheel drive skateboard. For example, the skateboard 10 may comprise one motor at each end driving both wheels via a locked differential, or one motor driving each wheel independently. The independent drive embodiment may provide increased efficiency and better turning. In addition, the drive system of the skateboard 10 may comprise one or more of a belt pulley, a direct drive gearbox, or hub motors directly inside one or more of the wheels.

Embodiments of the present invention provide a simple and lightweight mono-shock suspension system that is useful for all-terrain electric skateboards to provide riders with predictable and stable handling and steering in all kinds of terrains.

Although embodiments of the invention have been described above in the context of motorised skateboards, it will be appreciated that the mono-shock suspension system of the present invention may also be alternatively implemented in any conventional non-motorised skateboards.

For the purpose of this specification, the word "comprising" means "including but not limited to," and the word "comprises" has a corresponding meaning.

The above embodiments have been described by way of example only and modifications are possible within the scope of the claims that follow.

The invention claimed is:

1. A suspension for a skateboard, comprising:

a pair of steering knuckles on opposite sides of a chassis frame of the skateboard; a pair of upper control arms connected between the pair of steering knuckles and the chassis frame;

a pair of lower control arms connected between the pair of steering knuckles and the chassis frame; and a single and substantially horizontal first spring damper connected between the pair of upper control arms above the chassis frame.

2. The suspension of claim 1, further comprising an anti-roll system connected between the pair of upper control arms and the chassis frame.

3. The suspension of claim 2, wherein the anti-roll system comprises a pair of second spring dampers connected between the pair of upper control arms and the chassis frame.

4. The suspension of claim 2, wherein the anti-roll system biases the chassis frame to return to a neutral position after lateral tilting of the chassis about the longitudinal axis.

5. The suspension of claim 2, wherein each upper control arm comprises a generally pyramidal frame having an upper, inner vertex.

6. The suspension of claim 5, wherein the first spring damper is connected between the upper, inner vertices of pyramidal frames of the pair of upper control arms.

7. The suspension of claim 5, wherein the pair of second spring dampers are packaged inside the pyramidal frames of the pair of upper control arms.

8. The suspension of claim 2, wherein the first spring damper and the pair of second spring dampers each comprise a coil-over shock absorber.

9. The suspension of claim 1, wherein the suspension enables the skateboard to tilt laterally about a longitudinal axis of the chassis frame without changing ride height.

10. The suspension of claim 1, wherein each lower control arm comprises an A-arm or a wishbone.

11. A skateboard comprising at least one suspension of claim 1.

12. The skateboard of claim 11, wherein the skateboard comprises a pair of front wheels and a pair of rear wheels, and wherein the suspension of claim 1 is provided between each of the pairs of front and rear wheels.

13. The skateboard of claim 11, wherein the skateboard comprises a motorized all-terrain skateboard.

* * * * *